US006427645B1

(12) United States Patent
Geyer et al.

(10) Patent No.: US 6,427,645 B1
(45) Date of Patent: Aug. 6, 2002

(54) EXHAUST GAS CONTROL MECHANISM FOR A TWO-STROKE ENGINE

(75) Inventors: Werner Geyer, Berglen; Axel Klimmek, Schwaikheim, both of (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/721,787

(22) Filed: Nov. 22, 2000

(30) Foreign Application Priority Data

Nov. 23, 1999 (DE) ..... 199 56 157

(51) Int. Cl.[7] ..... F02B 75/02
(52) U.S. Cl. ..... 123/65 PE
(58) Field of Search ..... 123/65 PE; 60/312, 60/314, 324; 181/226

(56) References Cited

U.S. PATENT DOCUMENTS 4,558,566 A * 12/1985 Shirakura ..... 60/314
6,179,096 B1 * 1/2001 Kinerson et al. ..... 188/154

FOREIGN PATENT DOCUMENTS

DE 464508 * 8/1928

* cited by examiner

*Primary Examiner*—Tony M. Argenbright
*Assistant Examiner*—Katrina B. Harris
(74) *Attorney, Agent, or Firm*—R W Becker & Associates; R W Becker

(57) ABSTRACT

An exhaust gas control mechanism for a two-stroke engine is provided. A first housing chamber is in communication with a discharge window of the cylinder of the engine, while a second housing chamber has the exhaust gases flowing therethrough into an exhaust gas outlet. A flow communication establishes a controlled communication of flow of exhaust gas from the first chamber to the second chamber. A valve is provided for controlling the flow communication, wherein such valve, if initially open, closes upon partial opening of the discharge window and after a given period of time again opens.

18 Claims, 3 Drawing Sheets

EXHAUST GAS CONTROL MECHANISM FOR A TWO-STROKE ENGINE

BACKGROUND OF THE INVENTION

The present invention relates to an exhaust gas control mechanism for a two-stroke engine.

DE-C 464 508 discloses an exhaust gas control mechanism for a two-stroke engine, according to which the exhaust gas muffler is divided into two chambers. The first chamber communicates with the exhaust gas outlet via a large cross-sectional area, while the second chamber communicates with the exhaust outlet via a small cross-sectional area. The entry of exhaust gas into the second chamber is controlled by a valve that is open when the discharge window of the cylinder opens, and then closes as counterpressure builds up in the second chamber, and finally, after reduction of pressure in the second chamber, again opens. This is intended to reduce the operating noise of the two-stroke engine.

Since at the time period of the opened transfer window of the two-stroke engine into the first chamber the discharge window is opened, which adjoins a large outlet cross-sectional area at the exhaust gas outlet, it is not possible to prevent the fresh gases or fuel that enter for the rinsing or flushing to be discharged via the discharge window. Thus, considerable portions of unburned fuel/air mixture can be found in the exhaust gas, which is serious with regard to environmental pollution.

It is therefore an object of the present invention to provide an exhaust gas control mechanism for a two-stroke engine such that the rinsing losses that increase due to the manner of operation are reduced to a minimum.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
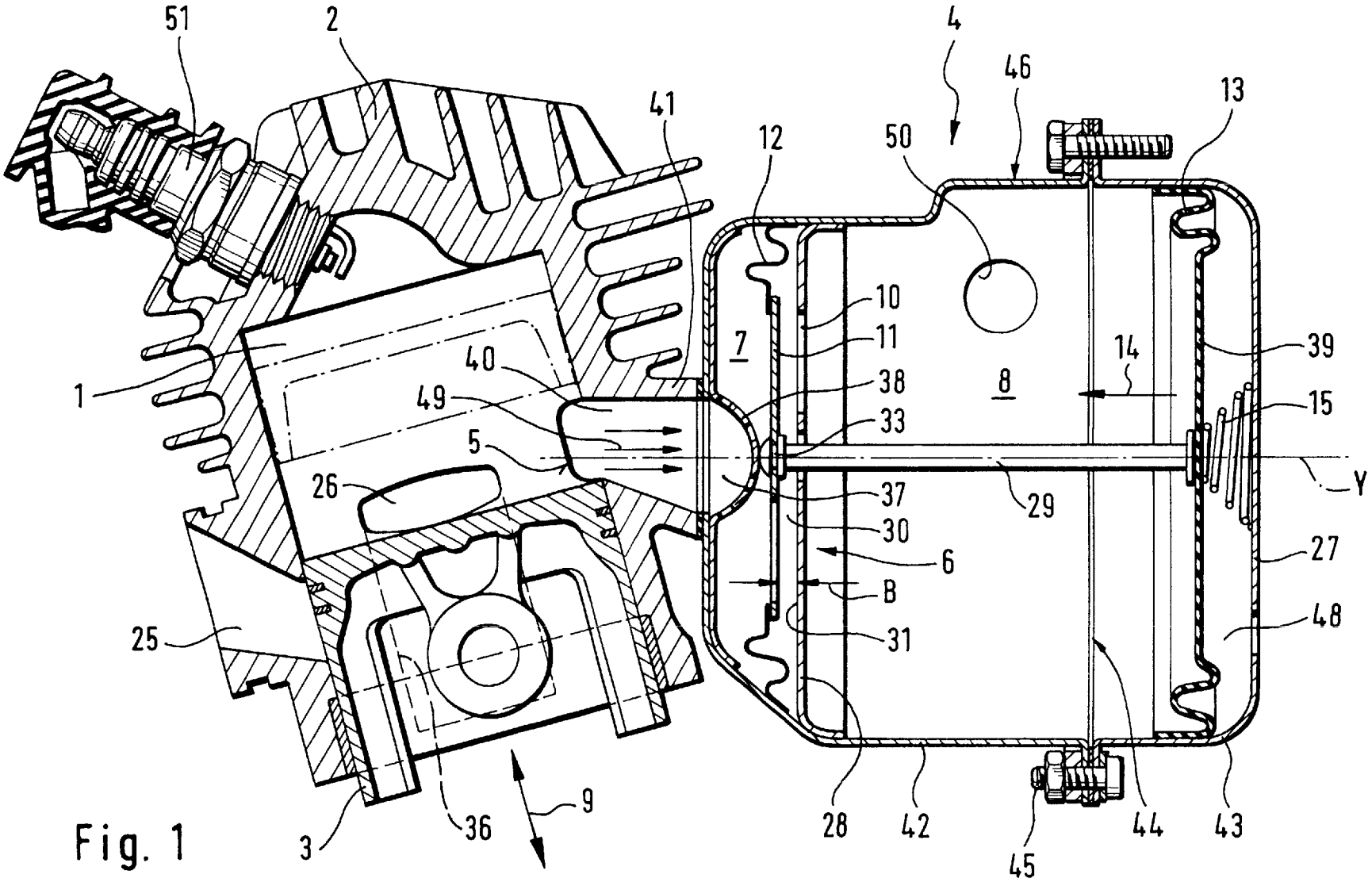
FIG. 1 is a schematic cross-sectional view through the cylinder of a two-stroke engine to which is flanged an exhaust gas muffler.

The exhaust gas control mechanism of the present invention comprises a housing having a first housing chamber, which is in communication with a discharge window of a cylinder of the engine, and a second housing chamber, through which flow exhaust gases into an exhaust gas outlet of the housing; flow communication means are provided for establishing a controlled communication of flow of exhaust gas from the first chamber into the second chamber; and a valve is disposed in the housing for controlling the flow communication means, wherein the valve, if initially opened, closes upon partial opening of the discharge window and after a given period of time again opens.

If the discharge window opens at the end of a power stroke, the exhaust gas, which is at a high pressure, flows via the first housing chamber and the valve into the second housing chamber, as a result of which a considerable portion of the exhaust gas can as designed be withdrawn. After a partial opening of the discharge window, the valve closes and separates the housing chambers, which are successively arranged one after the other, so that now for the discharge of the exhaust gases only a smaller volume is still available, which furthermore does not communicate with the exhaust gas outlet. For this reason, an exhaust gas counterpressure builds up in the first housing chamber and approximately at the point in time of the opening of the transfer window of the two-stroke engine is so great that only small portions of the inflowing fresh gas or fuel can still pass via the discharge window into the exhaust gas channel. Thus, the exhaust gas counterpressure that is built up in the first housing chamber counteracts rinsing losses. After a given period of time, the valve again opens the connection or communication between the housing chambers, so that the exhaust gas pressure in the first housing chamber can drop by means of the valve, the second housing chamber and the exhaust gas outlet. This is expediently effected after the fresh gas or fuel flows into the combustion chamber, advantageously at a period in time in which the piston again closes the discharge window. It can be expedient to only then open the flow communication between the chambers when the piston has completely closed the discharge window in the cylinder.

Pursuant to a further embodiment of the present invention, the volume of the first housing chamber is less than, and preferably significantly less than, the volume of the second housing chamber. For example, pursuant to one specific embodiment the volume of the first housing chamber is approximately one-fifth to one-tenth the volume of the second housing chamber.

The housing chambers are advantageously disposed in a common exhaust gas muffler, so that no additional space is required for the exhaust gas control mechanism. If the drive for the valve is also disposed within the muffler and is driven by exhaust gas pressure, an exhaust gas muffler configured in this way can also be retrofitted as a replacement in delivered two-stroke engines.

In order to reduce the resistance to flow during the transfer of the exhaust gases from the first housing chamber into the second housing chamber to a minimum, the flow communication can comprise a plurality of individual flow openings that are disposed in the covering area of the valve member and in the circumferential direction thereof are laterally spaced from one another. In conformity therewith, the valve member also has a plurality of flow openings that are distributed over the periphery thereof and that, when the valve member is viewed in plan, are respectively disposed in the spacing area between the flow openings of the flow communication that lead to the second housing chamber, so that when the valve member rests upon the valve seat the flow openings are closed off by wall portions of the valve member and the flow openings in the valve member are closed off by wall areas of the valve seat.

Further specific features of the present invention will be described in detail subsequently.

DESCRIPTION OF PREFERRED EMBODIMENTS

Referring now to the drawings in detail, the schematic illustration in FIG. 1 shows the cylinder 2 of a port-controlled two-stroke engine. The cylinder 2, together with a piston 3, delimit a combustion chamber 1 that is provided in the cylinder. The piston 3 travels back and forth in the direction of the arrow 9, thereby controlling not only a discharge window 5 for the discharge of the exhaust gases, but also a transfer window 26 via which fuel is supplied to the combustion chamber 1. By means of a transfer channel 36, which is illustrated in dashed lines, the transfer window 26 communicates with the crank case of the two-stroke engine into which, by means of an intake channel 5, the fresh gas or fuel as well as the fuel/air mixture necessary for the operation of the internal combustion engine are drawn. The intake channel 25 is also controlled by the piston 3.

The discharge window 5 opens into an exhaust gas channel 40 that is formed in the wall of the cylinder 2 and ends in a flange 41, to which, in the illustrated embodiment, an exhaust gas muffler 4 is secured.

The muffler 4 comprises a housing 46 that in turn comprises two housing portions 42 and 43 that are joined together in an exhaust gas tight manner at a dividing plane 44 by means of fastening screws 45.

Mounted in the housing 46 of the exhaust gas muffler 4 is a partition 28 that is secured in that housing portion 42 that faces the cylinder 2. The partition 28 divides the interior of the housing 46 into a first housing chamber 7 and a second housing chamber 8. The volume of the first housing chamber 7, which adjoins the exhaust gas channel 40, is less than, and in particular significantly less than, the volume of the second housing chamber 8. For example, the volume of the first housing chamber 7 can be approximately one-fifth to one-tenth of the volume of the second housing chamber 8; in the illustrated embodiment, the second housing chamber 8 is approximately ten times as large as the first housing chamber 7.

Disposed in the partition 28 is at least one flow opening 10, which forms a flow communication 6 between the first chamber 7 and the second chamber 8.

The flow communication 6 is disposed within a valve seat 31 of a valve 30, which comprises a valve member 11 that in the illustrated embodiment is formed by a valve plate. The valve plate 11 is disposed within the first chamber 7 approximately parallel to the partition 28 and at a distance B therefrom; the valve plate 11 is centered in the first housing chamber 7 by means of guide or locating elements 12. These elements 12 are distributed about the periphery of the valve member 10 and are spaced from one another; in the illustrated embodiment, four bellows-like guide elements 12 are provided and are respectively spaced from one another by a circumferential angle of 90°.

In the center 33, the valve member 11, which is embodied as a valve plate, is secured to the end of a push rod 29 that is disposed along the longitudinal central axis Y of the exhaust gas muffler 4, and which passes through the partition 28. The push rod 29 extends through the second housing chamber 8 and is connected to a displaceable wall 39 that, as a reenforced diaphragm plate of a diaphragm 13, delimits the volume of the second housing chamber 8. A chamber 48, which is preferably vented to the atmosphere, is partitioned off between the base 27 of the housing portion 43 and the displaceable wall 39 that is embodied as a diaphragm. A spring 15, preferably a coil spring, is disposed in the chamber 48. The coil spring 15 acts upon the valve member 11 in the direction of the arrow 14 with an opening force that holds that end of the push rod 29 that faces the valve against an abutment 38 that is formed by a hood that is permeable to exhaust gas and spans the exhaust gas inlet 38.

Figure 2:
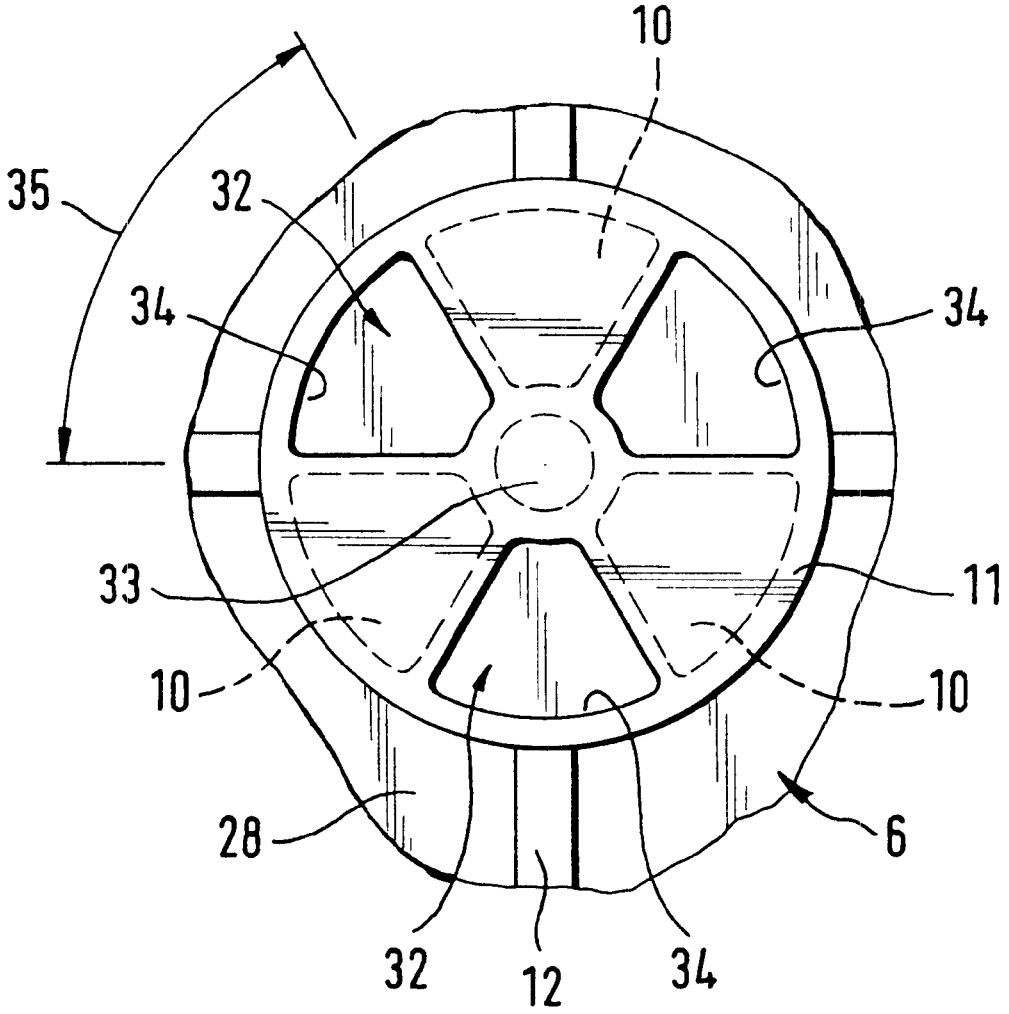
FIG. 2 is a plan view of a valve disposed between two housing chambers of the exhaust gas muffler.

As shown in FIG. 2, several flow openings 10 are provided in the partition 28 and together form the flow communication 6 between the chambers 7 and 8. The flow openings 10 are disposed in the covering area of the circular valve member 11, i.e. the valve plate, and in the circumferential direction thereof are spaced from one another by the lateral spacing 35.

Distributed in the valve member 11, which is embodied as a valve plate, over the periphery of the valve are several flow openings 34 which when viewing the valve plate 11 in plan are respectively disposed in the areas 32 between each two flow openings 10 of the partition 28. The provision of several flow openings 34 ensures a low resistence to flow despite the arrangement of the valve 30, so that the exhaust gas, which enters the first, low volume housing chamber with high pressure, can pass via the flow openings 34 and the flow openings 10 in a largely unobstructed manner into the larger volume housing chamber 8. For this purpose, a structurally prescribed, suitable spacing B of the valve member 11 from the partition 28 is provided.

If the piston travels downwardly out of its upper dead center position, which is illustrated by dot-dash lines in FIG. 1, the piston first passes over the upper edge of the discharge window 5, for which reason exhaust gas 49 that is under high pressure flows off through the discharge window 5 and the exhaust gas channel 40 into the first housing chamber 7, and via the open valve 30 into the second housing chamber 8. Since the exhaust gas channel 50 that withdraws the exhaust gas from the second housing chamber has a smaller cross-sectional area than the cross-sectional area of the passage of the flow communication 6 between the housing chambers 7 and 8, an increasing exhaust gas pressure builds up in the second housing chamber 8 until this pressure is so great that it displaces the wall 39, i.e. the diaphragm plate, counter to the direction of the arrow 14 against the force of the spring 15 until the valve member that is embodied as the valve plate 11 overcomes the spacing B and rests against the valve seat 31 on the partition 28. In so doing, due to the offset arrangement of the flow openings 34 relative to the flow openings 10, the flow openings 10 are respectively closed, as a consequence of which the first housing chamber 7 is separated in an exhaust gas tight manner from the second housing chamber 8. The valve 30 closes off the flow communication 6 approximately in a time period where the piston 3, which is traveling in the direction toward the lower dead center position, releases the transfer window 26 of the transfer channel 36. The fresh gases or fuel that flow in rinse the combustion chamber 1, however cannot escape via the discharge window 5 due to the exhaust gas counter pressure that builds up in the small-volume first housing chamber 7. Although portions of the fuel pass into the small-volume first housing chamber 7 with the remainder of the exhaust gas, the majority of the fuel remains in the combustion chamber 1. The loss of rinsing gas that occurs is that much less the smaller is the volume of the first housing chamber 7 that directly adjoins the exhaust gas channel 40.

During the further downward movement of the piston, an exhaust gas pressure is reduced via the exhaust gas channel 50, whereby as a function of the design of the spring 15, as the pressure drops below a threshold pressure the push rod 29 is displaced back in the direction of the arrow 14 and the valve 30 is again opened. The exhaust gas counterpressure that has built up in the first housing chamber 7 can be relieved via the valve 30 and the flow communication 6, whereby approximately at the time period of the renewed opening of the valve 30 the piston 3, as a result of its upward movement, has nearly completely closed the transfer window 26 and the discharge window 5 in order to compress the fuel that has flowed into the combustion chamber 1 for the next power stroke. In the region of the upper dead center position (see the dot-dashed illustration in FIG. 1) ignition of the compressed mixture is effected by the spark plug 51, and the piston again travels in the direction of the lower dead center position.

Figure 3:
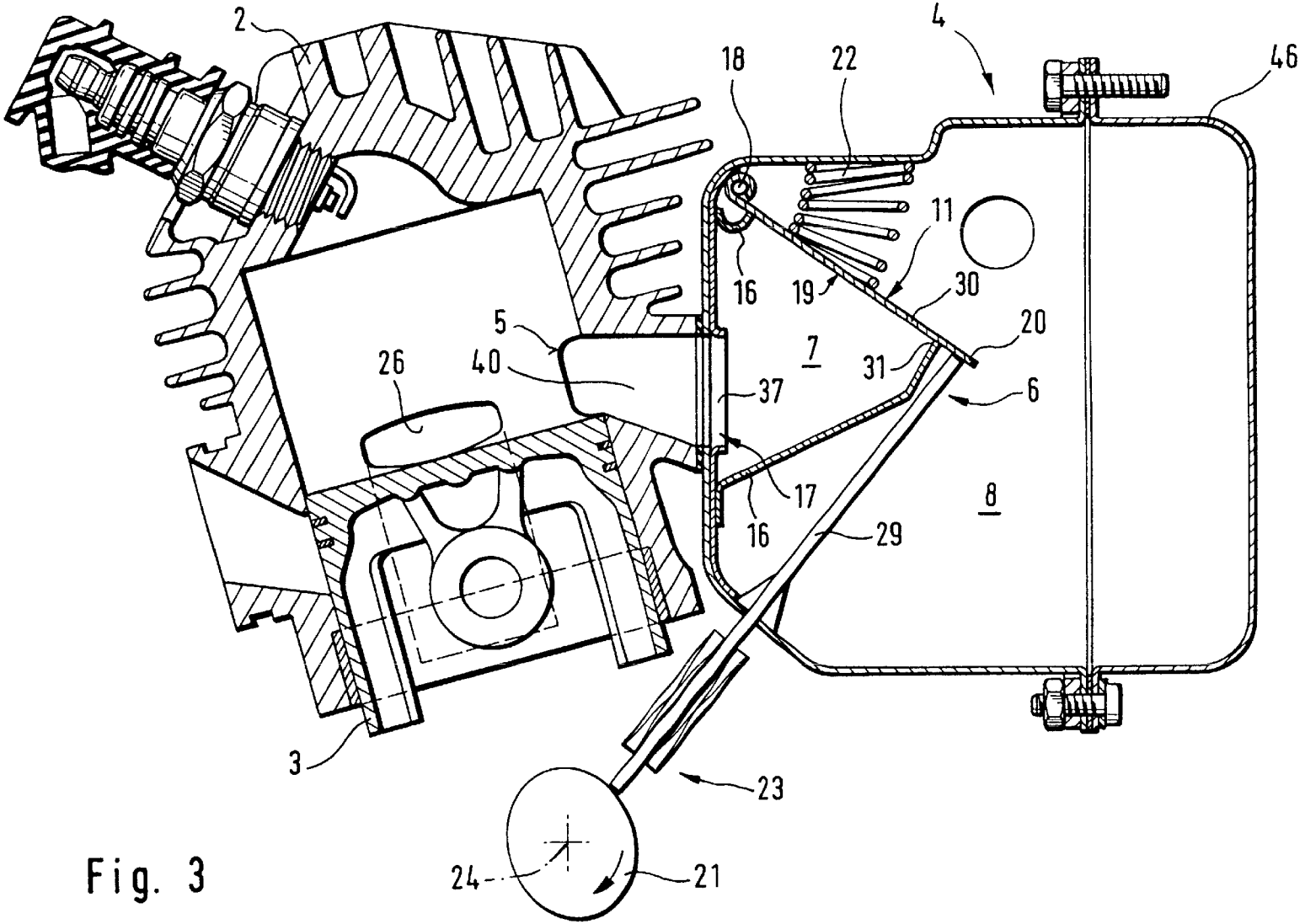
FIG. 3 is a schematic cross-sectional view through the cylinder and an exhaust gas muffler flanged thereto and including a further exemplary embodiment of an inventive exhaust gas control mechanism.

The basic construction of the exemplary embodiment illustrated in FIG. 3 corresponds to that of FIG. 1, for which reason the same components have been provided with the same reference numerals. One difference from the embodiment of FIGS. 1 and 2 is that the exhaust gas channel 40 is extended by an essentially cylindrical housing connector 16 into the housing 46 of the exhaust gas muffler 4. The cylindrical housing connector 16, together with the exhaust gas channel 40 in the cylinder 2, form a common exhaust gas channel 17 that leads from the discharge window 5 to the second housing chamber 8. The common exhaust channel 17 thus forms the smaller volume first exhaust chamber 7, whereby by reducing the size of the common exhaust channel 17 a minimal volume of the first housing chamber 7 can be provided.

The opening 19 of the common exhaust channel 17 into the second housing chamber 8 forms the flow communication 6 between the first housing chamber 7 and the second housing chamber 8. The opening 19 of the common exhaust gas channel 17, which extends into the second housing chamber 8, is closed off by the valve member 11, whereby the rim of the opening 19 forms the valve seat 31. In the embodiment illustrated in FIG. 3, the valve member 11 is again embodied as a valve plate, and in particular a valve plate that is pivotable about an axis of rotation 18; the edge portion of the valve plate projects beyond the valve seat 31. The valve member 11, which is embodied as a valve plate or a valve cover, is urged by a spring 22, especially a coil spring, into the closing position illustrated in FIG. 3 in which the opening 19 of the common exhaust gas channel 17 into the second housing chamber 8 is closed off.

As with the exemplary embodiment of FIG. 1, during operation of the internal combustion engine as the discharge window 5 opens the valve 30 must initially be open in order to convey the high pressure exhaust gas into the larger volume second housing chamber 8. Approximately in the time period in which the piston oper s the transfer window 26 for the entry of fresh gas or fuel, the valve 30 is to close and to be kept closed over a given period of time until, with the piston traveling upwardly and the discharge window 5 closing, the valve 30 is again opened.

To operate the valve 30 of FIG. 3, a rod drive is provided according to which that end of the push rod 29 that extends into the second housing chamber 8 engages against the projecting rim 20 of the valve member 11 in order to open the valve member against the force of the spring 22 for connecting the first housing chamber 7 with the second housing chamber 8. The push rod 29 is operated by a cam drive 23 that can comprise a cam that is disposed, for example, upon the crank shaft 24. The contour of the cam 21 is selected such that as the discharge window 5 opens, the flow communication 6 opens; in other words, the valve 30 is opened, and at least shortly after opening of the transfer window 26 the valve is closed by the force of the spring 22 as the push rod 29 travels back. It can be expedient to slowly again open the valve 30 already when the discharge window 5 is still opened, which can be effected by an appropriate incline of the cam. The valve 30 is expediently open when the piston travels in a direction toward the upper dead center position, and the discharge window 5 is substantially or completely closed. The cam drive 23 is disposed externally of the housing 46 of the exhaust gas muffler 4; the push rod 29 projects into the second housing chamber 8.

The specification incorporates by reference the disclosure of German priority document 199 56 157.5 of Nov. 23, 1999.

The present invention is, of course, in no way restricted to the specific disclosure of the specification and drawings, but also encompasses any modifications within the scope of the appended claims.

What we claim is:

1. An exhaust gas control mechanism for a two-stroke engine, comprising:

a housing having a first housing chamber, which is in communication with a discharge window of a cylinder of said engine, and a second housing chamber, through which flow exhaust gases into an exhaust gas outlet of said housing;

flow communication means disposed in said housing for establishing a controlled communication of flow of exhaust gases from said first housing chamber into said second housing chamber; and a valve disposed in said housing for controlling said flow communication means, wherein said valve, if initially open, closes upon partial opening of said discharge window and after a given period of time again opens.

2. An exhaust gas control mechanism according to claim 1, wherein said first housing chamber has a volume that is smaller than, a volume of said second housing chamber.

3. An exhaust gas control mechanism according to claim 2, wherein the volume of said first housing chamber is approximately one-fifth to one-tenth of the volume of said second housing chamber.

4. An exhaust gas control mechanism according to claim 1, wherein said housing is part of an exhaust gas muffler in which both of said housing chambers are disposed.

5. An exhaust gas control mechanism according to claim 1, wherein said valve includes a valve member that is embodied as a valve plate, and wherein said valve member is associated with a valve seat that extends about said flow communication means.

6. An exhaust gas control mechanism according to claim 1, wherein said flow communication means comprises several individual flow openings that are disposed in a covering area of said valve member and in a circumferential direction of such valve member are laterally spaced from one another.

7. An exhaust gas control mechanism according to claim 6, wherein said valve member is provided with several flow openings that are distributed over the periphery thereof and that, when said valve member is viewed in plan, are respectively disposed in a spacing region between said flow openings of said flow communication means.

8. An exhaust gas control mechanism according to claim 1, wherein a push rod is provided for actuating a valve member of said valve.

9. An exhaust gas control mechanism according to claim 8, wherein said push rod extends out of said second housing chamber to engage said valve member.

10. An exhaust gas control mechanism according to claim 8, wherein drive means for said push rod is disposed within said second housing chamber.

11. An exhaust gas control mechanism according to claim 8, wherein said push rod is actuated by a drive mechanism that is acted upon by exhaust gas pressure in said second housing chamber.

12. An exhaust gas control mechanism according to claim 11, wherein said drive mechanism is formed by a pressure-displaceable wall, which is connected to said push rod and delimits said second housing chamber.

13. An exhaust gas control mechanism according to claim 11, wherein a partition is provided between said first and second housing chambers, wherein said valve member is disposed in said first housing chamber, and wherein said push rod extends through said partition.

14. An exhaust gas control mechanism according to claim 8, wherein a cam drive is provided that is driven by a crank shaft of said two-stroke engine, and wherein said push rod is actuated by said cam drive.

15. An exhaust gas control mechanism according to claim 14, wherein said valve member is pivotable about an axis of rotation.

16. An exhaust gas control mechanism according to claim 1, wherein the volume of said first housing chamber is formed by an exhaust gas channel that is disposed between said discharge window of said cylinder and said second housing chamber, and wherein said exhaust gas channel is adapted to be closed off by a valve member of said valve.

17. An exhaust gas control mechanism according to claim 16, wherein said exhaust gas channel extends into said second housing chamber.

18. An exhaust gas control mechanism according to claim 16, wherein a spring is provided for urging said valve member into a closed position.

* * * * *